US007836664B2

(12) United States Patent
Zanini et al.

(10) Patent No.: US 7,836,664 B2
(45) Date of Patent: Nov. 23, 2010

(54) UNIT FOR FITTING SCREW CAPS TO THE NECKS OF RESPECTIVE CONTAINERS

(75) Inventors: Gianpietro Zanini, Montanara di Curtatone (IT); Marco Baroni, Barbasso di Roncoferraro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 0 days.

(21) Appl. No.: 12/227,288

(22) PCT Filed: May 15, 2007

(86) PCT No.: PCT/IB2007/001249

§ 371 (c)(1),
(2), (4) Date: Nov. 13, 2008

(87) PCT Pub. No.: WO2007/132337

PCT Pub. Date: Nov. 22, 2007

(65) Prior Publication Data

US 2009/0223169 A1 Sep. 10, 2009

(30) Foreign Application Priority Data

May 17, 2006 (IT) ..... BO2006A0375

(51) Int. Cl.
*B67B 1/06* (2006.01)

(52) U.S. Cl. ..... 53/317; 53/284.5; 53/331.5; 53/334

(58) Field of Classification Search ..... 53/420, 53/471, 476, 484, 485, 490, 284.6, 287, 302, 53/310, 317, 331.5, 334, 376.2, 284.5
See application file for complete search history.

(56) References Cited

U.S. PATENT DOCUMENTS 2,082,048 A 6/1937 Everett (Continued)

FOREIGN PATENT DOCUMENTS

GB 718766 11/1954

*Primary Examiner*—Christopher Harmon
(74) *Attorney, Agent, or Firm*—Timothy J. Kilma; Shuttleworth & Ingersoll, PLC

(57) ABSTRACT

Screw caps (2) are fitted to the necks of respective containers (3) by a unit comprising a carousel equipped with a platform on which the containers are placed, a frame positioned above the platform, and a drive system by which the platform and the frame are set in rotation about a main vertical axis. The unit comprises at least one screw capping device (7) associated with the rotating frame of the carousel, located above a respective container (3) and equipped with a gripping mechanism (9) lockable onto the cap (2) of the container, also a first motion-inducing linkage (25) by which the gripping mechanism (9) is caused to rotate about an axis (Y) parallel to the main vertical axis, and a second motion-inducing linkage (37) by which the gripping mechanism (9) is moved toward or away from the respective cap (2). The screw capping device (7) is packaged internally of a box-like body (10) associated removably with the rotating frame and housing the gripping mechanism (9).

33 Claims, 4 Drawing Sheets

U.S. PATENT DOCUMENTS

| | | | | |
|---|---|---|---|---|
| 2,187,429 | A | 1/1940 | Newey | |
| 3,040,492 | A | 6/1962 | Stover | |
| 5,301,488 | A * | 4/1994 | Ruhl et al. | 53/55 |
| 5,419,094 | A * | 5/1995 | Vander Bush et al. | 53/75 |
| 5,533,608 | A * | 7/1996 | Adams et al. | 198/478.1 |
| 5,884,677 | A * | 3/1999 | McKaughan | 141/145 |
| 6,105,343 | A * | 8/2000 | Grove et al. | 53/490 |
| 6,679,026 | B1 * | 1/2004 | Cirio | 53/317 |
| 7,347,032 | B2 * | 3/2008 | Cirio | 53/334 |

* cited by examiner

UNIT FOR FITTING SCREW CAPS TO THE NECKS OF RESPECTIVE CONTAINERS

This application is the National Phase of International Application PCT/IB2007/001249 filed May 15, 2007 which designated the U.S. and that International Application was published under PCT Article 21(2) in English.

TECHNICAL FIELD

The present invention relates to a unit for fitting screw caps to the necks of respective containers.

BACKGROUND ART

The prior art embraces capping units embodied as a rotating carousel with a platform designed to carry a plurality of containers designed to hold substances of various nature including liquid food products, typically milk or fruit juices, and non-food products such as mineral lubricating oils, detergents, etc.

The containers occupy respective bays formed in the circumferential edge of the platform and are directed along a circular path from an infeed station to an outfeed station.

The carousel also presents a frame positioned above and rotatable as one with the platform, carrying a plurality of devices by which screw caps are twisted each onto the threaded neck of a relative container.

Each device is positioned above a corresponding container and presents a gripper by which a relative cap is held tight and rotated in such a way as to screw it onto the neck.

Thus, as the containers are caused to move along the circular path, the gripper of each device will approach and grip a respective screw cap, then effect the rotational movement, and finally release the cap when tightened.

In particular, the gripper is associated with a rotating shaft rendered capable of vertical motion through the agency of respective cam means, by which shaft and gripper can be moved toward and away from the cap of a relative container as the frame rotates. The cam means coincide with a stationary portion of the frame and are engaged by a following roller associated with the shaft.

The shafts are set in rotation by way of dedicated transmission systems coupled to a single motor, or alternatively, each of the screw capping devices can be equipped with a respective motor coupled directly to the shaft.

Screw capping devices are also equipped generally with a clutch, by which rotary motion is transmitted from the shaft to the gripper. As the screw cap is fully tightened and the clutch begins to slip, at the moment when the resisting torque on the gripper exceeds a prescribed value, the shaft and the gripper become uncoupled, with the result that the gripper ceases motion while the shaft continues to rotate.

At this point, the gripper opens gradually so as to release the cap, and another container can be admitted. The open-and-close movement of the gripper is produced by an actuator, guided by the movement of the shaft and acting directly on the gripper.

In reality, prior art units of the type outlined above are affected by serious drawbacks connected with the structure of the screw capping devices.

A first significant drawback derives from the lack of versatility afforded by such devices, which can be utilized only with containers having predetermined physical characteristics.

In effect, the shaft, the gripper, and the drive components operating the shaft and the gripper, are proportioned according to the height of the container and of the screw cap.

Consequently, the capping unit cannot be used to handle containers notably dissimilar one from another in terms of their physical characteristics.

Also, it will be appreciated that the device is anchored to the upper frame of the carousel, and that with multiple motion-inducing components installed, like the cam means and the means of transmitting rotation, associated respectively with the shaft and with the motor located in the carousel, the screw capping devices cannot be removed and replaced with others of different specification.

A further drawback of the unit in question derives from the structural complexity of the clutch coupling between the shaft and the gripper. Not only are the clutches composed of delicate and intricate component parts; they also contribute to an excessive bulkiness of the assembled carousel, which carries a sizeable number of capping devices.

Finally, another drawback stems from the fact that when the carousel is in rotation, the shaft of the screw capping device continues to rotate even when the cap is not engaged by the device.

In effect, when the cap has been screwed onto the respective container, the clutch will uncouple the gripper from the shaft, whereupon the shaft continues to rotate by itself until such time as the gripper engages another screw cap.

As a result, the motor, the shaft and the relative transmission components run idle for a given period during operation of the carousel, consuming energy to no good purpose.

The object of the present invention is to provide a unit for fitting screw caps to the necks of respective containers, such as will be unaffected by the drawbacks described above.

In particular, one object of the present invention is to set forth a unit with screw capping devices controllable according to the type of container being capped.

A further object of the present invention is to provide a screw capping unit that will be simple in construction, economical, suitably compact and able to suspend the rotation of components internally of the capping device.

DISCLOSURE OF THE INVENTION

The stated objects are realized, according to the present invention, in a unit for fitting screw caps to the necks of respective containers, comprising: a carousel presenting a platform on which to stand respective containers, and an upper frame positioned above the platform; drive means, associated with the carousel, by which the platform and the frame are set in rotation about a respective vertical axis; at least one screw capping device associated with the upper frame, positioned above a respective container and equipped with a gripping mechanism lockable onto the cap of a container; first motion-inducing means acting on the screw capping device, by which the gripping mechanism is caused to rotate about an axis parallel to the vertical axis; and second motion-inducing means acting on the screw capping device, by which the gripping mechanism is moved toward or away from the respective cap, characterized in that the screw capping device further comprises a box-like body associated removably with the upper frame, internally of which the gripping mechanism is housed.

The invention will now be described in detail, by way of example, with the aid of the accompanying drawings, in which.

Figure 1:
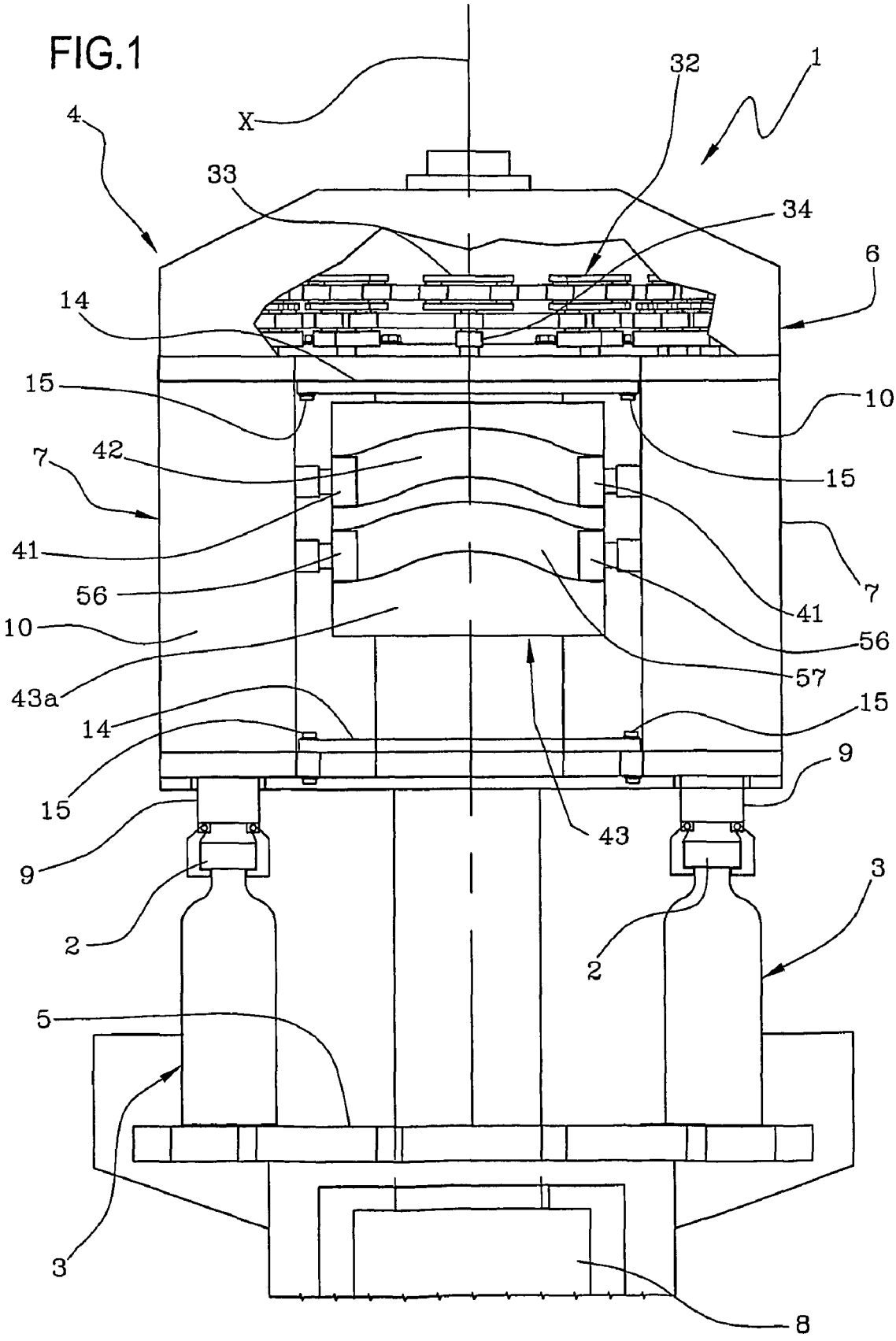
FIG. 1 shows a unit for fitting screw caps to the necks of respective containers according to the present invention, viewed in side elevation and with certain parts omitted better to reveal others.
Figure 4:
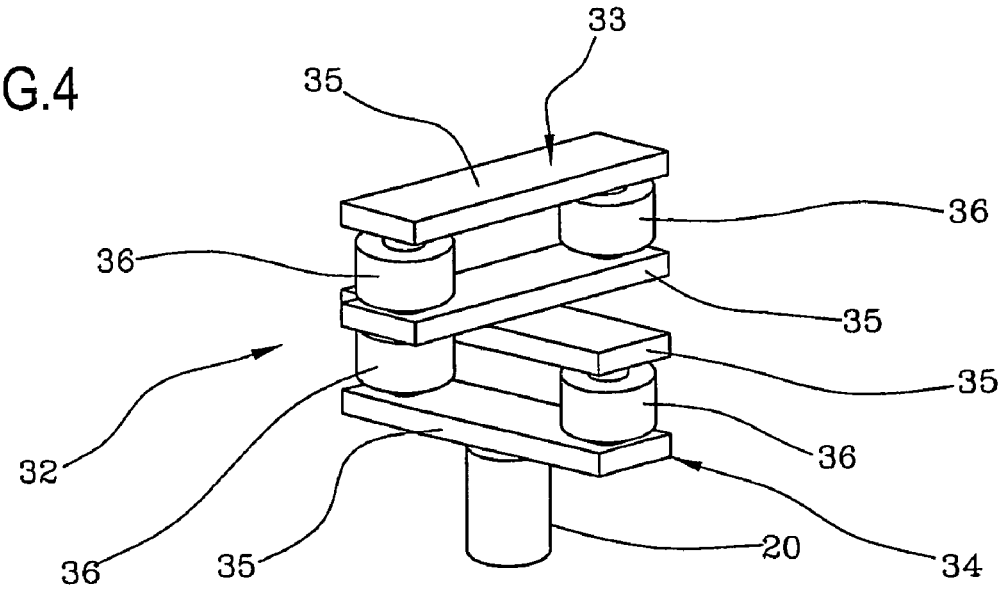
Figure 3A:
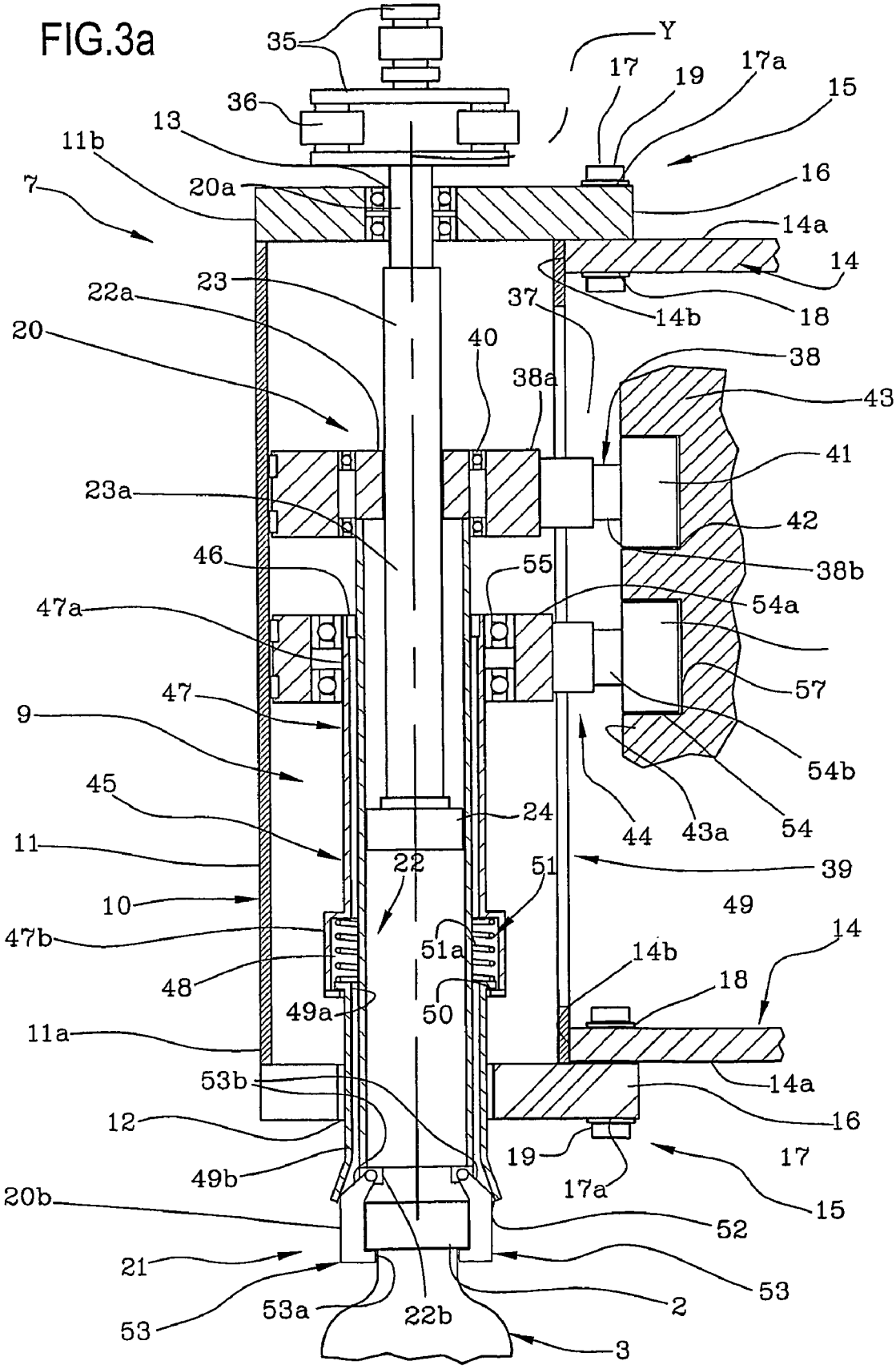
Figure 3B:
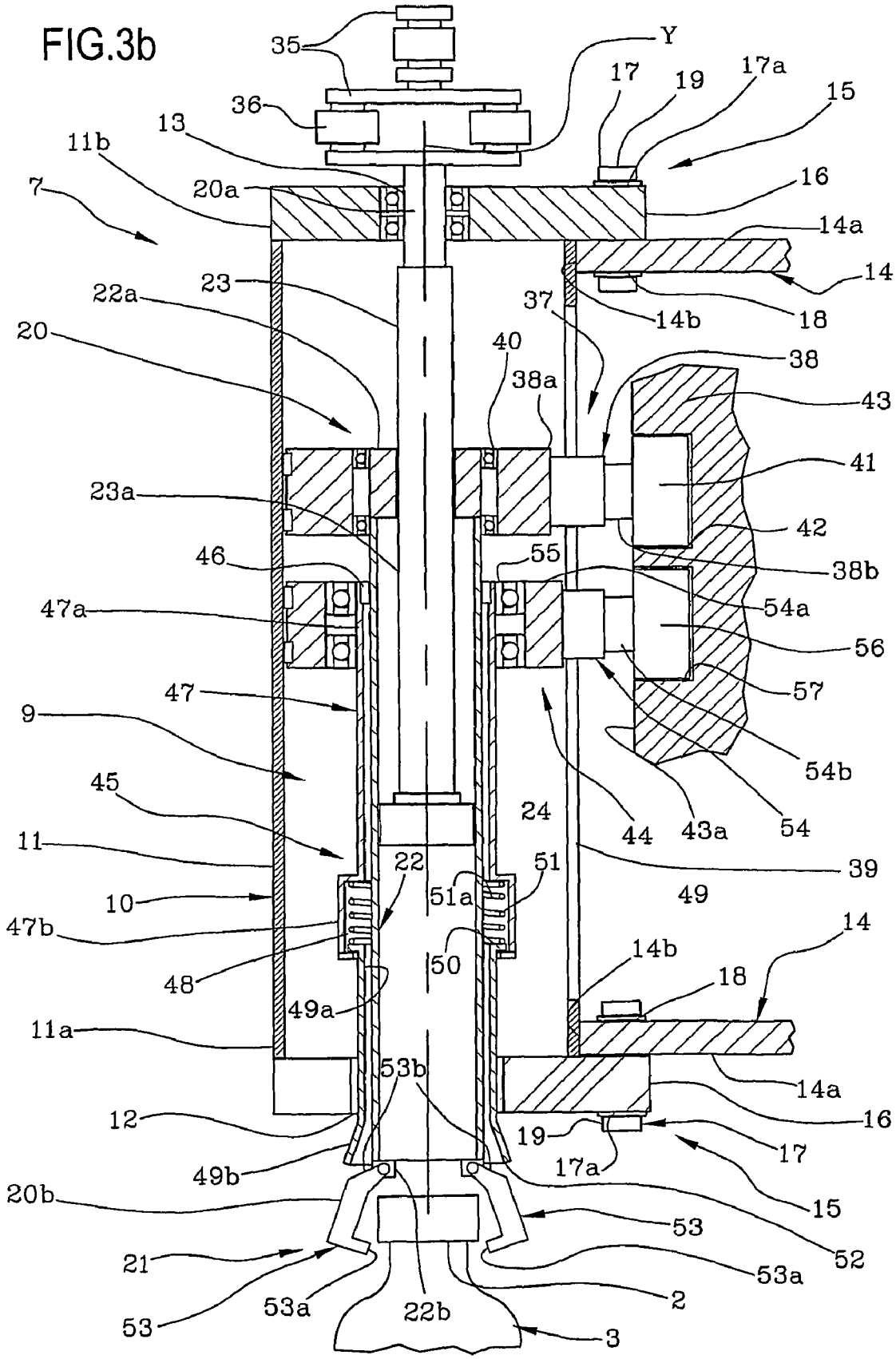

FIG. 3*a* shows a screw capping device associated with the unit illustrated in FIG. 1, viewed in longitudinal section and in a first operating configuration;

FIG. 3*b* shows a screw capping device associated with the unit illustrated in FIG. 1, viewed in longitudinal section and in a second operating configuration;

FIG. 4 shows a constructional detail of the device illustrated in FIGS. 3*a* and 3*b*, viewed in perspective.

With reference to FIG. 1, numeral 1 denotes a unit, in its entirety, for fitting screw caps 2 to the necks of respective containers 3.

Generally considered, the unit 1 comprises a carousel 4 with a substantially flat platform 5 of which the periphery presents a circular outline. The platform 5 creates a seating able to accommodate a plurality of containers 3 arranged in single file around the circumferential edge of the platform 5.

Also forming part of the carousel 4 is an upper frame 6, positioned above the platform 5 and serving to carry at least one screw capping device 7, as will be explained in due course.

The capping unit 1 further comprises drive means 8, associated with the carousel, by which the platform 5 and the frame 6 are set in rotation simultaneously about a respective vertical axis "X".

Thus, as the platform 5 rotates, it will carry the containers 3 along a feed path "A" from an infeed station, at which the single containers 3 are taken up on the selfsame platform 5, to an outfeed station.

Advantageously, the periphery of the upper frame 6 carries a plurality of screw capping devices 7, each positioned above a respective container 3. As the containers 3 proceed along the feed path "A", the devices 7 advance together with the containers 3 and are able to screw a cap 2 onto the neck of each one.

In particular, each screw capping device 7 presents a box-like body 10 associated removably with the frame 6, and a gripping mechanism 9 housed within the box-like body 10, positioned to engage the cap 2 of the relative container 3. More exactly, the box-like body 10 presents a tubular wall 11 of which a first end 11*a* is directed toward the container 3 positioned beneath and affords an opening 12 proportioned so as to admit the passage of the gripping mechanism 9.

The tubular wall 11 also presents a second end 11*b* opposite to the first, which affords a connecting hole 13.

As illustrated in FIGS. 1 and 3, the frame 6 is composed of at least one carrier 14 presenting a substantially platter-like appearance, with a flat top surface 14*a* and a peripheral edge 14*b* facing the tubular wall 11 of each screw capping device 7.

The screw capping device 7 also presents connecting means 15 of separable type associated with the box-like body 10 and with the frame 6, such as will allow the displacement of the device 7 between a fastened position, in which the selfsame device is attached to the frame 6, and an unfastened position in which the device is detached from the frame 6.

In more detail, such separable connecting means 15 comprise at least one projecting portion 16 presented by the tubular wall 11, extending transversely to the planar development of the selfsame wall 11. In a preferred solution, the projecting portion 16 will be embodied integrally with the tubular wall 11.

The connecting means 15 further comprise a coupling element 17 insertable in a hole 17*a* afforded by the projecting portion 16, and in an opening 18 afforded by the carrier 14.

As shown clearly in FIGS. 3*a* and 3*b*, the projecting portion 16 rests on the top surface 14*a* of the carrier 14, placed so that the relative hole 17*a* is coaxial with the aforementioned opening 18. In this situation, the box-like body 10 is cantilevered from and located outside the dimensional envelope of the frame 6.

To advantage, the coupling element 17 is embodied as a threaded pin 19, for instance a bolt, screwed into the hole 17*a* and into the opening 18.

In accordance with a preferred embodiment shown in FIGS. 1, 3*a* and 3*b*, the frame 6 incorporates two carriers 14, distanced one from another. Here, the aforementioned connecting means 15 will comprise two projecting portions 16, each issuing from a relative end 11*a* and 11*b* of the tubular wall 11.

In accordance with a preferred embodiment shown in FIGS. 1, 3*a* and 3*b*, the frame 6 incorporates two carriers 14, distanced one from another. Here, the aforementioned connecting means 15 will comprise two projecting portions 16, each issuing from a relative end 11*a* and 11*b* of the tubular wall 11.

Each projecting portion 16 is associated with the respective carrier 14 by way of the aforementioned coupling element 17, in such a way that the entire device 7 remains stably connected to the frame 6.

With the coupling element 17 provided by a threaded bolt 19, advantageously, this same element can be removed and refitted manually, and the screw capping device 7 detached from or attached to the frame 6.

The gripping mechanism 9, illustrated to advantage in FIGS. 3*a* and 3*b*, comprises a rotating shaft 20 of which a first end 20*a* projects from the connecting hole 13 and a second end 20*b*, opposite to the first, carries a gripper element 21 that projects from the aforementioned opening 12.

More exactly, the shaft 20 consists in a hollow cylindrical element 22 housed coaxially within the tubular wall 11, of which a top end 22*a* is directed toward the connecting hole 13 and a bottom end 22*b* constitutes the second end 20*b* of the shaft 20.

A spindle 23 projecting from the top end 22*a* of the cylindrical element 22, through and beyond the connecting hole 13, constitutes the first end 20*a* of the shaft 20.

More precisely, the spindle 23 presents an active portion 23*a* housed within the tubular wall 11 and accommodated slidably by the top end 22*a* of the cylindrical element 22, as will become clear in due course. The active portion 23*a* of the spindle 23 is also furnished with a keying element 24 housed in the cylindrical element 22, by which this same element 22 is locked to and set in rotation as one with the spindle 23 about a respective axis "Y" parallel to the axis "X" mentioned previously.

The unit 1 further comprises first motion-inducing means 25 associated with the screw capping device 7, by which the aforementioned gripping mechanism 9 is caused to rotate about the axis denoted "Y".

More exactly, the first motion-inducing means 25 consist in a fixed wheel 26 attached to the top of the frame 6 and presenting a circumferential edge 26*a* that extends along the aforementioned feed path "A".

Figure 2:
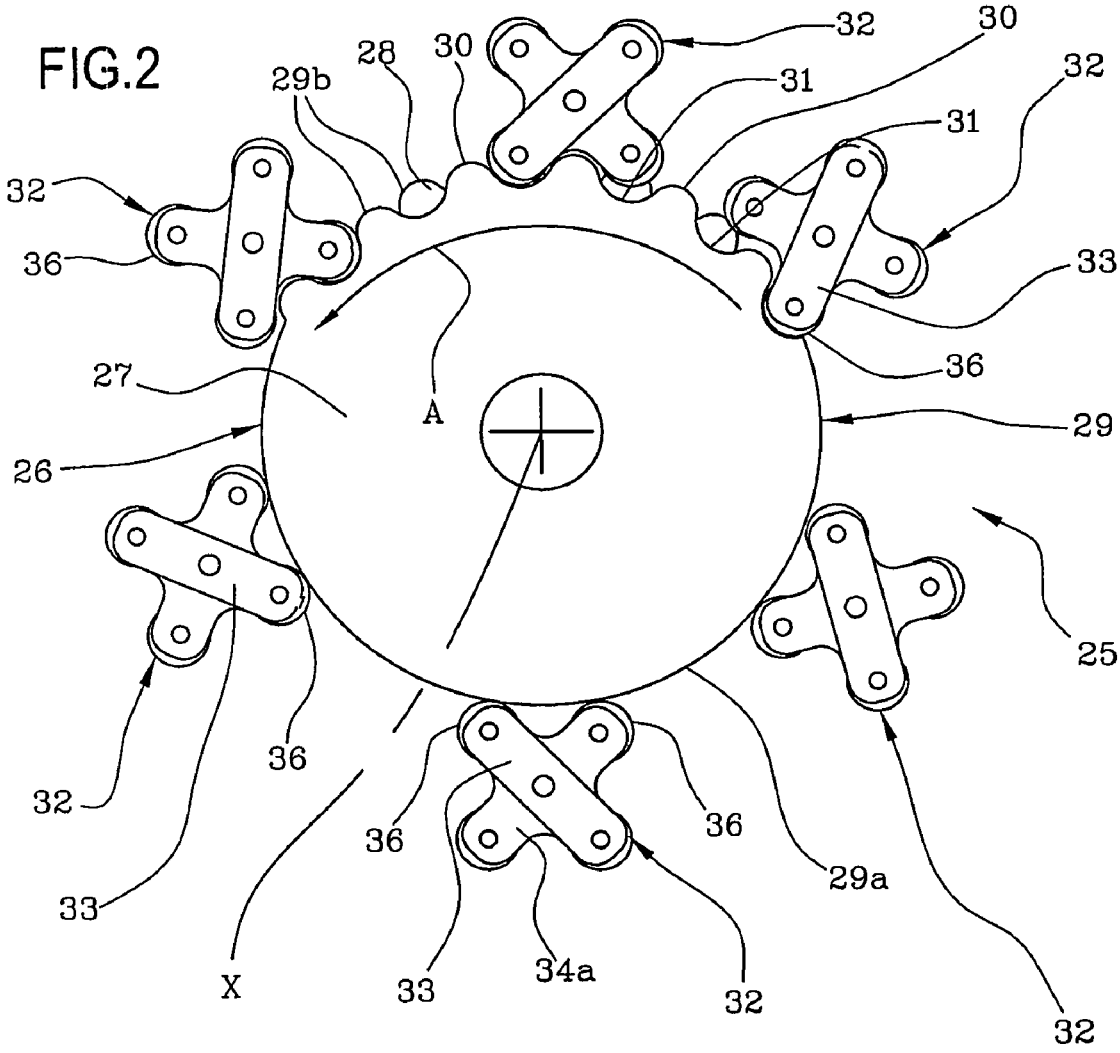
FIG. 2 shows a top portion of the unit illustrated in FIG. 1, viewed schematically and in plan from above.

In particular, the fixed wheel 26 comprises a top disc 27 and a bottom disc 28, both of substantially platter-like appearance and disposed one above the other, occupying respective parallel planes. Each disc 27 and 28 presents a rim 29 extending around the circumferential edge 26*a* of the wheel 26, composed of a smooth arcuate portion 29*a* and a convoluted arcuate portion 29*b* (FIG. 2).

In detail, the smooth arcuate portion 29*a* presents a continuous circular outline, whilst the convoluted arcuate portion 29*b* appears as a plurality of rounded lobes 30 alternated with respective recesses 31, also rounded. Thus, as discernible in FIG. 2, where the first motion-inducing means 25 are illustrated in isolation, the rim 29 of each disc 27 and 28 appears circular, with the convoluted arcuate portion 29*b* extending along the feed path "A" followed by the advancing containers 3.

It will be seen also that the convoluted arcuate portions 29*b* of the two discs 27 and 28 occupy a common sector and are staggered. In other words, each lobe 30 presented by the top disc 27 is aligned on a respective recess 31 of the bottom disc 28.

The first motion-inducing means 25 further comprise a rotary element 32 associated permanently with the first end 20*a* of the shaft 20, or rather with the spindle 23 emerging from the hole 13, and placed to interact with the edge 26*a* of the fixed wheel 26.

As illustrated to advantage in FIGS. 3*a* and 3*b*, and in the detail of FIG. 4, the rotary element 32 is composed of a primary engagement member 33 and a secondary engagement member 34, each offered to the rim 29 of a respective disc 27 and 28.

In more detail, each engagement member 33 and 34 comprises a pair of plates 35, each of substantially elongated appearance and rectangular outline. The plates 35 of each pair are disposed parallel and distanced one from another so as to accommodate a pair of cylindrical rollers 36, also distanced one from another.

More exactly, the rollers 36 are located between and positioned at respective opposite ends of the two plates 35.

To advantage, the rollers 36 carried by each pair of plates 35 are rotatable about respective axes parallel to the rotational axis "Y" of the shaft 20.

In addition, the engagement members 33 and 34 are located one on top of another and joined at mid-point along the plates 35, the plates 35 of the primary member 33 extending perpendicular to the plates 35 of the secondary member 34.

Thus, the engagement members 33 and 34 are arranged in the form of a Maltese cross.

Still referring to FIGS. 3 and 4, it will be seen that when the screw capping device 7 passes along the smooth arcuate portion 29*a* of the disc, the relative engagement members 33 and 34 remain stationary. More exactly, one roller 36 of each member 33 and 34 rolls against the smooth arcuate portion 29*a* in this situation, thus maintaining the position of the two members 33 and 34 unchanged relative to the frame 6. Similarly, the shaft 20 is not set in rotation.

When the screw capping device 7 passes along the convoluted arcuate portion 29*b*, the engagement members 33 and 34 will pivot about the axis "Y" of rotation. In this situation, the rollers 36 of each member 33 and 34 mesh with the lobes 30 of the convoluted arcuate portion 29*b*, thereby inducing angular motion in the rotary element 32.

In other words, the rollers 36 of each engagement member 33 and 34 locate in the recesses 31, and the plates 35 flip from one lobe 30 to another.

Accordingly, the shaft 20 will rotate only when the rotary element 32 passes along the convoluted arcuate portion 29*b* of each disc 27 and 28.

In an alternative embodiment of the invention, not illustrated in the accompanying drawings, the first motion-inducing means 25 might consist in an electric motor mounted directly to the box-like body 10.

In this instance, each screw capping device 7 would be equipped with a respective motor coupled directly to the first end 20*a* of the shaft 20.

The unit 1 further comprises second motion-inducing means 37 associated with the screw capping device 7, by which the gripping mechanism 9 can be moved toward and away from the respective screw cap 2.

In particular, the second motion-inducing means 37 comprise a primary connecting element 38 appearing substantially cylindrical in shape, presenting a first portion 38*a* associated with the hollow cylindrical element 22 and a second portion 38*b* remote from the first portion 38*a*.The second portion 38*b* of the primary connecting element 38 passes through and beyond the tubular wall 11, projecting from a slot 39 afforded by the selfsame wall 11 at a point between the aforementioned projecting portions 16.

The first portion 38*a* of the primary connecting element 38 comprises an annular bearing 40 breasted circumferentially with the hollow cylindrical element 22. The annular bearing 40 allows the cylindrical element 22 to turn on the axis "Y" of rotation relative to the connecting element 38, while also disallowing any linear movement of the cylindrical element 22 relative to the connecting element 38 in a direction parallel to the selfsame axis "Y". Thus, whenever vertical motion is induced in the primary connecting element 38, the same vertical motion will be induced in the cylindrical element 22.

The second motion-inducing means 37 also comprise a following roller 41 associated with the second portion 38*b* of the primary connecting element 38 and rotatable about an axis transverse to the axis "Y" of rotation.

The roller 41 lies between the carriers 14 of the frame 6 and is inserted freely in a first cam profile 42 afforded by a fixed drum 43.

In particular, the fixed drum 43 is substantially cylindrical in shape and interposed between the two carriers 14 of the frame 6. The drum 43 also presents a cylindrical surface 43*a* directed toward the capping devices 7, in which the first cam profile 42 is fashioned.

More precisely, the first cam profile 42 is fashioned as an annular groove such as will induce a measure of movement in the cylindrical element 22 along the axis "Y", toward and away from the respective screw cap 2.

Thus, when the capping device 7 is caused to revolve around the vertical axis "X", the roller 41 runs along the first cam profile 42, following the trajectory imposed by this same profile 42.

The gripping mechanism 9 further comprises actuator means 44 associated with the rotating shaft 20 and interacting with the gripper element 21, to the end of switching the selfsame gripper element 21 between a tightened configuration (FIG. 3*a*), in which a relative screw cap 2 is held fast, and a spread configuration (FIG. 3*b*) in which the element 21 is distanced from the cap 2.

As illustrated clearly in FIGS. 3*a* and 3*b*, the actuator means 44 in question comprise a tubular sleeve 45 associated coaxially with the outer surface of the cylindrical element 22. Advantageously, the tubular sleeve 45 is associated with the cylindrical element 22 via suitable axial sliding means 46 of conventional embodiment, not described in detail, by which the selfsame sleeve 45 is rendered slidable relative to the cylindrical element 22 in a direction parallel to the axis "Y" of rotation.

In greater detail, the tubular sleeve 45 comprises a first annular portion 47 presenting a top end 47*a* directed toward the top end 22*a* of the cylindrical element 22, and a bottom end 47*b* of cross sectional width greater than that of the top end 47*a*.That is to say, the bottom end 47*b* of the first annular portion 47 consists in a widened portion, distanced from the cylindrical element 22 so as to create an annular chamber 48.

The tubular sleeve 45 also presents a second annular portion 49 of which a top end 49*a* is accommodated coaxially within the aforementioned annular chamber 48, between the bottom end 47*b* of the first annular portion 47 and the cylindrical element 22. It will be seen also that the top end 49*a* of the second annular portion 49 presents a locating surface 50 of annular geometry engaging a flexible bias element 51 housed in the annular chamber 48. In this situation, the second annular portion 49 is rendered slidable in relation to the first annular portion 47, and the top end 49*a* capable of movement within the chamber 48. The movement of the second annular portion 49 thus causes the locating surface 50 to shift toward or away from the flexible element 51, which compresses or expands as a result. To advantage, the flexible element 51 consists in a coil spring 51*a* centred on the axis "Y" of rotation.

A bottom end 49*b* of the second annular portion 49 presents a splayed profile, with an annular lip 52 directed toward the gripper element 21.

The gripper element 21 comprises at least two jaws 53 associated with the bottom end 22*b* of the cylindrical element 22 and located on opposite sides of the axis "Y" of rotation. In practice, the gripper element 21 might equally well be equipped with three jaws 53, equispaced about the selfsame axis "Y".

Each single jaw 53 is likenable substantially to a letter 'C' in outline, hinged to the cylindrical element 22 and pivotable thus about an axis disposed transversely to the axis "Y" of rotation. Each jaw 53 also presents a bottom locating surface 53*a* offered in contact to the side of the cap 2, and an angled top surface 53*b* remote from the bottom surface 53*a*.

As illustrated in FIGS. 3*a* and 3*b*, the annular lip 52 of the second annular portion 49 is designed to impinge on the angled surfaces 53*b* of the jaws 53 and rotate the selfsame jaws into the tightened configuration.

In other words, when the tubular sleeve 45 is set in motion along the axis "Y" of rotation toward the gripper element 21, the annular-lip 52 enters into contact with the angled surfaces 53*b* and causes the locating surfaces 53*a* to approach the screw cap 2, which will be gripped ultimately by these same surfaces 53*a*.When the sleeve 45 moves away from the gripper element 21, the lip 52 separates from the angle surfaces 53*b* and the jaws 53 are able to pivot away from the cap 2.

Motion is induced in the tubular sleeve 45 by a secondary connecting element 54 of substantially cylindrical appearance presenting a first portion 54*a* associated with the tubular sleeve 45 and a second portion 54*b*, remote from the first, passing through the slot 39 and projecting from the tubular wall 11. In particular, the second portion 54*b* of this element 54 lies parallel with and below the second portion 38*b* of the primary connecting element 38.

In like manner to that of the primary connecting element 38, the first portion 54*a* of the secondary connecting element 54 presents an annular bearing 55, breasted circumferentially in this instance with the first annular portion 47 of the tubular sleeve 45. The annular bearing 55 allows the sleeve 45 to turn on the axis "Y" of rotation relative to the connecting element 54, while also disallowing linear movement of the sleeve 45 in a direction parallel to the selfsame axis "Y". Thus, whenever motion is induced in the secondary connecting element 54, the same vertical motion will be induced in the tubular sleeve 45.

The aforementioned actuator means 44 also comprise a following roller 56 associated with the second portion 54*b* of the secondary connecting element 54 and rotatable about an axis transverse to the axis "Y" of rotation.

The roller 56 is accommodated within a second cam profile 57 afforded by the cylindrical surface 43*a* of the fixed drum 43.

The second cam profile 57 is positioned below the first cam profile 42 and consists in an annular groove generating a degree of movement in the tubular sleeve 45 along the axis "Y", toward and away from the gripper element 21.

Accordingly, as the screw capping devices 7 revolve about the aforementioned vertical axis "X", the following rollers 41 and 56 run internally of the respective cam profiles 42 and 57, inducing motion in the sleeve 45 and the cylindrical element 22 along the axis "Y" of rotation, independently of one another.

Thus, when a device 7 of the unit 1 is about to screw a cap 2 onto a relative container 3, the cylindrical element 22 moves toward the container, stopping once the gripper is level with the cap. As motion is induced, the cylindrical element 22 slides along the active portion 23*a* of the spindle 23 and is guided thus by spindle along their common axis "Y".

Thereafter, the sleeve 45 is directed forcibly against the gripper element 21 to close the jaws 53 and take a firm hold on the cap 2.

At this juncture, the rotary element 32 encounters the convoluted arcuate portions 29*b* of the discs 27 and 28. Consequently, the spindle 23 associated with the rotary element 32 rotates about the axis "Y" and the resulting angular movement is transmitted to the associated cylindrical element 22, causing the cap 2 held by the gripper element 21 to twist onto the neck of the container.

As the rotary element 32 reaches the smooth arcuate portions 29*a* of the discs, it will cease rotation. At this point, the cap 2 will have been screwed fully onto the container 3 and the sleeve 45 is distanced from the gripper element 21 to release the cap 2.

The cylindrical element 22 will then also be raised and distanced from the container 3.

Advantageously, in the event that a different size of container 3 needs to be capped by the unit 1, the existing devices 7 can be removed and replaced by other devices 7 with specifications suitable for the new container 3.

In effect, by disassembling the separable connecting means 15, the box-like body 10 and all the mechanical linkages housed therein can be detached from the frame 6. In this situation, the operation of removing and fitting the screw capping devices 7 is especially simple, since all that is required is for the threaded bolt 19 to be unscrewed from and subsequently reinserted through the relative projecting portion 16 and the carrier 14 of the frame 6.

In addition, the unit 1 has no drive transmission components of any kind interposed between the frame 6 and the devices 7, such as would prevent the devices 7 being detached from the carousel 4.

In effect, as regards the first motion-inducing means 25, the rotary element 32 is easily offered to and detached from the fixed wheel 26. Likewise in the case of the second motion-inducing means 37, the following rollers 41 and 56 are easily separated from and located in the cam profiles.

Accordingly, the entire unit 1 is scalable and adaptable to suit different types of containers 3.

It will be seen also that the shaft 20 turns on the relative axis "Y" only when the gripper element 21 is tightened on a screw cap. In effect, when the rotary element 32 rides against the smooth arcuate portions 29*a*, the shaft 20 ceases rotation, and there is no needless waste of energy produced by allowing the shaft to turn idle.

Finally, the screw capping devices 7 are self-evidently of modest proportions and especially compact, given that all of the necessary components are housed within the box-like body 10. Moreover, the capping devices 7 are simple in construction, given that no use is made of delicate mechanical clutch-coupling components.

The invention claimed is:

1. A unit for fitting screw caps to the necks of respective containers, comprising:

a carousel having a platform on which to stand respective containers, and an upper frame positioned above the platform;

a drive mechanism, associated with the carousel, by which the platform and the frame are set in rotation about a respective vertical axis;

at least one screw capping device associated with the upper frame, positioned above a respective container and equipped with a gripping mechanism lockable onto the cap of a container;

a first motion-inducing mechanism acting on the screw capping device, by which the gripping mechanism is caused to rotate about an axis parallel to the vertical axis;

a second motion-inducing mechanism acting on the screw capping device, by which the gripping mechanism is moved toward and away from the respective cap;

the screw capping device further comprising a hollow body removably attachable to the upper frame, internally of which the gripping mechanism is housed; the hollow body being cantilevered from and located outside a dimensional envelope of the frame;

a separable connecting mechanism associated with the hollow body and the frame, allowing the radial displacement of the screw capping device between a fastened position in which the screw capping device is attached as a unit to the frame, and an unfastened position in which the screw capping device can be radially removed as a unit from the frame.

2. A unit as in claim 1, wherein the hollow body includes a tubular wall and the connecting mechanism is associated with the tubular wall of the hollow body, of which a first end is directed toward a respective container and includes an opening affording a passage to the gripping mechanism, and a second end, opposite to the first end, includes a connecting hole.

3. A unit as in claim 2, wherein the connecting mechanism comprises at least one projecting portion attached to the screw capping device and extending transversely to a longitudinal axis of the screw capping device, and a coupling element insertable in a hole afforded by the projecting portion.

4. A unit as in claim 3, wherein the frame comprises at least one carrier having a substantially flat top surface delimited by a peripheral edge, and the projecting portion rests on the top surface of the carrier, placed over an opening aligned coaxially with the hole in the projecting portion in such a way that the coupling element can be inserted through the hole and through the opening.

5. A unit as in claim 4, wherein the coupling element comprises a threaded pin screwed into the hole and into the opening.

6. A unit as in claim 3, wherein the connecting mechanism comprises two projecting portions presented respectively by the first end and by the second end of the tubular wall, each accommodating a respective coupling element, and the frame comprises two carriers distanced one from another, each associated with a respective projecting portion.

7. A unit as in claim 2, wherein the gripping mechanism comprises a rotating shaft having a first end projecting from the connecting hole, externally of the tubular wall, a second end opposite to the first end, and at least one gripper element, associated with the second end of the shaft and projecting from the opening.

8. A unit as in claim 7, wherein the shaft comprises a hollow cylindrical element constituting the second end of the shaft and housed within the tubular wall, also a spindle constituting the first end of the shaft, which includes an active portion housed within the tubular wall, accommodated slidably by the cylindrical element and furnished with a keying element by which the spindle and the cylindrical element are caused to rotate as one about an axis of the shaft.

9. A unit as in claim 8, wherein the second motion-inducing mechanism comprises a primary connecting element having a first portion associated with the hollow cylindrical element and a second portion, remote from the first portion, passing through a slot in the tubular wall and projecting externally of the tubular wall.

10. A unit as in claim 9, wherein the carousel further comprises a fixed drum interposed between the carriers of the frame, having a cylindrical surface directed toward the screw capping device, and the second motion-inducing mechanism further comprises a following roller associated rotatably with the second portion of the primary connecting element and running internally of a first cam profile afforded by the cylindrical surface of the fixed drum.

11. A unit as in claim 10, wherein the first cam profile includes an annular groove by which movement is induced in the cylindrical element along the axis of rotation, toward and away from the respective screw cap.

12. A unit as in claim 10, wherein the gripping mechanism further comprises an actuator mechanism associated with the rotating shaft and interacting with the gripper element, for switching the gripper element between a tightened configuration, in which a relative screw cap is held securely, and a spread configuration in which the element is distanced from the cap.

13. A unit as in claim 12, wherein the actuator mechanism comprises a tubular sleeve associated coaxially with the outer surface of the cylindrical element, a secondary connecting element having a first portion associated with the tubular sleeve, and a second portion remote from the first portion, passing through the slot and projecting externally of the tubular wall, and a following roller associated with the second portion of the secondary connecting element, running internally of a second cam profile afforded by the cylindrical surface of the fixed drum.

14. A unit as in claim 13, wherein the second cam profile includes an annular groove by which movement is induced in the tubular sleeve along the axis of rotation, toward and away from the gripper element.

15. A unit as in claim 13, wherein the tubular sleeve comprises a first annular portion having a top end with which the first portion of the secondary connecting element is associated, and a bottom end of cross sectional width greater than that of the top end, a second annular portion having a top end insertable coaxially into the bottom end of the first portion, and a bottom end of splayed profile having an annular lip directed toward the gripper element, and a flexible bias element housed in the bottom end of the first annular portion.

16. A unit as in claim 15, wherein the flexible bias element includes a coil spring, and the second annular portion of the tubular sleeve is movable along the axis of rotation within the bottom end of the first annular portion for compressing and relaxing the coil spring.

17. A unit as in claim 15, wherein the gripper element comprises at least two jaws hinged respectively on opposite sides to the bottom end of the cylindrical element and pivotable thus about respective axes transverse to the axis of rotation of the gripping mechanism, the annular lip of the second annular portion being forcible against the jaws so as to rotate the jaws toward the respective cap when assuming the tightened configuration, and distanced from the jaws when in the spread configuration.

18. A unit as in claim 7, wherein the first motion-inducing mechanism comprises a fixed wheel positioned above and associated with the frame of the carousel, a circumferential edge extending along a substantially circular path, and a rotary element associated permanently with the first end of the shaft, placed to interact with the circumferential edge of the fixed wheel.

19. A unit as in claim 18, wherein the fixed wheel comprises a top disc and a bottom disc disposed one above the other and occupying respective parallel planes, each having a circumferential rim extending along the circular path.

20. A unit as in claim 19, wherein the circumferential rim of each disc comprises a smooth arcuate portion and a convoluted arcuate portion, contiguous to the smooth arcuate portion, having a plurality of rounded lobes alternated with corresponding rounded recesses and staggered in such a way that the lobes of the top disc are aligned with the recesses of the bottom disc.

21. A unit as in claim 20, wherein the rotary element is composed of a primary engagement member comprising a pair of plates having a substantially elongated appearance, disposed parallel and distanced one from another, and a pair of cylindrical rollers located between the plates, rotatable about respective axes parallel to the axis of rotation of the shaft, also a secondary engagement member associated with the primary engagement member, comprising a pair of plates having a substantially elongated appearance, disposed parallel and distanced one from another and perpendicular to the longitudinal dimension of the plates of the primary engagement member, and a pair of cylindrical rollers located between the plates and rotatable about respective axes parallel to the axis of rotation of the shaft.

22. A unit as in claim 21, wherein each engagement member rolls against the rim of a respective disc, in such a way that each pair of rollers will both mesh with the respective convoluted arcuate portion of the disc, thereby causing the relative engagement member to turn on the axis of rotation, and ride against the smooth arcuate portion of the disc, thereby allowing the engagement member to advance without turning.

23. A unit as in claim 22, wherein the rollers of each engagement member are insertable in the recesses of the respective convoluted arcuate portion, and the lobes are insertable between two cylindrical rollers of a respective engagement member.

24. A unit as in claim 1, comprising a plurality of screw capping devices associated with the periphery of the frame and positioned above respective containers.

25. A unit for fitting screw caps to the necks of respective containers, comprising:

a carousel having a platform on which to stand respective containers, and an upper frame positioned above the platform;

a drive mechanism, associated with the carousel, by which the platform and the frame are set in rotation about a respective vertical axis;

at least one screw capping device associated with the upper frame, positioned above a respective container and equipped with a gripping mechanism lockable onto the cap of a container;

a first motion-inducing mechanism acting on the screw capping device, by which the gripping mechanism is caused to rotate about an axis parallel to the vertical axis;

a second motion-inducing mechanism acting on the screw capping device, by which the gripping mechanism is moved toward and away from the respective cap;

the screw capping device further comprising a hollow body removably attachable to the upper frame, internally of which the gripping mechanism is housed;

the hollow body having a tubular wall, of which a first end is directed toward a respective container and includes an opening affording a passage to the gripping mechanism, and a second end, opposite to the first end, includes a connecting hole wherein the gripping mechanism comprises a rotating shaft having a first end projecting from the connecting hole, externally of the tubular wall, a second end opposite to the first end, and at least one gripper element, associated with the second end of the shaft and projecting from the opening wherein the gripping mechanism further comprises an actuator mechanism associated with the rotating shaft and interacting with the gripper element, for switching the gripper element between a tightened configuration, in which a relative screw cap is held securely, and a spread configuration in which the element is distanced from the cap;

wherein the shaft comprises a hollow cylindrical element constituting the second end of the shaft and housed within the tubular wall;

wherein the actuator mechanism comprises a tubular sleeve associated coaxially with an outer surface of the cylindrical element, a connecting element having a first portion associated with the tubular sleeve, and a second portion remote from the first portion, passing through a slot in the tubular wall and projecting externally of the tubular wall, and a following roller associated with the second portion of the connecting element, running internally of a cam profile of a cylindrical surface of a fixed drum interposed between carriers of the frame.

26. A unit as in claim 25, wherein the cam profile includes an annular groove by which movement is induced in the tubular sleeve along an axis of rotation, toward and away from the gripper element.

27. A unit as in claim 26, wherein the tubular sleeve comprises a first annular portion having a top end with which the first portion of the secondary connecting element is associated, and a bottom end of cross sectional width greater than that of the top end, a second annular portion having a top end insertable coaxially into the bottom end of the first portion, and a bottom end of splayed profile having an annular lip directed toward the gripper element, and a flexible bias element housed in the bottom end of the first annular portion.

28. A unit as in claim 27, wherein the flexible bias element includes a coil spring, and the second annular portion of the tubular sleeve is movable along the axis of rotation within the bottom end of the first annular portion for compressing and relaxing the coil spring.

29. A unit as in claim 28, wherein the gripper element comprises at least two jaws hinged respectively on opposite sides to a bottom end of the cylindrical element and pivotable thus about respective axes transverse to the axis of rotation of the gripping mechanism, the annular lip of the second annular portion being forcible against the jaws so as to rotate the jaws toward the respective cap when assuming the tightened configuration, and distanced from the jaws when in the spread configuration.

30. A unit for fitting screw caps to the necks of respective containers, comprising:

a carousel having a platform on which to stand respective containers, and an upper frame positioned above the platform;

a drive mechanism, associated with the carousel, by which the platform and the frame are set in rotation about a respective vertical axis;

at least one screw capping device associated with the upper frame, positioned above a respective container and equipped with a gripping mechanism lockable onto the cap of a container;

a first motion-inducing mechanism acting on the screw capping device, by which the gripping mechanism is caused to rotate about an axis parallel to the vertical axis;

a second motion-inducing mechanism acting on the screw capping device, by which the gripping mechanism is moved toward and away from the respective cap;

the screw capping device further comprising a hollow body removably attachable to the upper frame, internally of which the gripping mechanism is housed;

wherein the hollow body includes a tubular wall and the connecting mechanism is associated with the tubular wall of the hollow body, of which a first end is directed toward a respective container and includes an opening affording a passage to the gripping mechanism, and a second end, opposite to the first end, includes a connecting hole;

wherein the gripping mechanism comprises a rotating shaft having a first end projecting from the connecting hole, externally of the tubular wall, a second end opposite to the first end, and at least one gripper element, associated with the second end of the shaft and projecting from the opening wherein the first motion-inducing mechanism comprises a fixed wheel positioned above and associated with the frame of the carousel, a circumferential edge extending along a substantially circular path, and a rotary element associated permanently with the first end of the shaft, placed to interact with the circumferential edge of the fixed wheel;

wherein the fixed wheel comprises a top disc and a bottom disc disposed one above the other and occupying respective parallel planes, each having a circumferential rim extending along the circular path;

wherein the circumferential rim of each disc comprises a smooth arcuate portion and a convoluted arcuate portion, contiguous to the smooth arcuate portion, having a plurality of rounded lobes alternated with corresponding rounded recesses and staggered such that the lobes of the top disc are aligned with the recesses of the bottom disc.

31. A unit as in claim 30, wherein the rotary element is composed of a primary engagement member comprising a pair of plates having a substantially elongated appearance, disposed parallel and distanced one from another, and a pair of cylindrical rollers located between the plates, rotatable about respective axes parallel to the axis of rotation of the shaft, also a secondary engagement member associated with the primary engagement member, comprising a pair of plates having a substantially elongated appearance, disposed parallel and distanced one from another and perpendicular to the longitudinal dimension of the plates of the primary engagement member, and a pair of cylindrical rollers located between the plates and rotatable about respective axes parallel to the axis of rotation of the shaft.

32. A unit as in claim 31, wherein each engagement member rolls against the rim of a respective disc, in such a way that each pair of rollers will both mesh with the respective convoluted arcuate portion of the disc, thereby causing the relative engagement member to turn on the axis of rotation, and ride against the smooth arcuate portion of the disc, thereby allowing the engagement member to advance without turning.

33. A unit as in claim 32, wherein the rollers of each engagement member are insertable of the respective convoluted arcuate portion, and the lobes are insertable between two cylindrical rollers of a respective engagement member.

* * * * *